United States Patent [19]

Kuwahara

[11] Patent Number: 4,962,647

[45] Date of Patent: Oct. 16, 1990

[54] REFRIGERATING CIRCUIT APPARATUS WITH TWO STAGE COMPRESSOR AND HEAT STORAGE TANK

[75] Inventor: Eiji Kuwahara, Shizuoka, Japan

[73] Assignee: Kabushika Kaisha Toshiba, Kawasaki, Japan

[21] Appl. No.: 318,792

[22] Filed: Mar. 3, 1989

[30] Foreign Application Priority Data

Jun. 30, 1988 [JP] Japan ..... 63-160780

[51] Int. Cl.[5] ..... F25D 21/06; F25B 47/02

[52] U.S. Cl. ..... 62/156; 62/278; 62/196.2; 62/510

[58] Field of Search ..... 62/278, 277, 196.4, 62/196.2, 81, 160, 324.5, 196.1, 196.3, 510, 156

[56] References Cited

U.S. PATENT DOCUMENTS 3,012,415 12/1961 La Porte ..... 62/278
3,838,582 10/1974 Redfern et al. ..... 62/278 X
3,869,874 3/1975 Ditzler ..... 62/278
4,833,893 5/1989 Morita ..... 62/278 X

FOREIGN PATENT DOCUMENTS 58-72851 4/1983 Japan .
58-205063 11/1983 Japan .

*Primary Examiner*—Harry B. Tanner
*Attorney, Agent, or Firm*—Finnegan, Henderson Farabow, Garrett & Dunner

[57] ABSTRACT

A refrigerating circuit apparatus includes a two stage compressor having an upper stage compressing cylinder and a lower stage compressing cylinder, a heat storage tank, an upper stage side variable opening expansion valve and a lower stage side variable opening expansion valve. The upper stage side variable opening expansion valve is controlled toward its closed position for executing a heat storing operation wherein heat is discharged from refrigerant to the heat storage tank. The upper stage side variable opening expansion valve is opened and the lower stage side variable opening expansion valve is closed for carrying out a defrosting operation. Heat stored in the heat storage tank is used in the defrosting operation for removing frost accumulated on an external heat-exchanger during the heating operation.

9 Claims, 3 Drawing Sheets

CONTROLLER
OPERATION SECTION 47
51
19
17a
17
11
21
37
39
23
17c
61
27a
25a
29
13
15
17b
27
25
41
53
57
43
CONTROLLER
45
OPERATION SECTION 47
51
B
A
19
17a
17
21
37
39
23
11
C
A
B
61
13
27a
25a
29
15
17b
27
25
41
53
57

REFRIGERATING CIRCUIT APPARATUS WITH TWO STAGE COMPRESSOR AND HEAT STORAGE TANK

BACKGROUND OF THE INVENTION

1. Field of the Invention

This invention relates, in general, to refrigerating circuit apparatus. In particular, the invention relates to a heat-pump type air conditioning apparatus which carries out a heating or cooling operation by changing the flow direction of refrigerant fed from the compressing device.

2. Description of the Related Art

As is well known, a conventional heat-pump type air conditioning apparatus includes a compressor, a four-way valve, an internal heat-exchanger, an expansion valve and an external heat-exchanger. In such a conventional air conditioning apparatus described above, since refrigerant flowing through the external heat-exchanger absorbs heat from the external air through the external heat-exchanger, frost may adhere to the external heat-exchanger (evaporator) during a heating operation when the external temperature decreases in winter. This is because temperature of the external heat-exchanger decreases, and moisture in the external air condensates and adheres on the external heat-exchanger. The frost accumulated on the external heat-exchanger causes a decrease in the heat-exchange ability of the external heat-exchanger, resulting in the decrease in the heating ability of the air conditioning apparatus. Thus, a defrosting operation should be carried out regularly. In the conventional heat-pump type air conditioning apparatus, the defrosting operation is carried out by changing the direction of the refrigerant fed from the compressor to remove frost built up on the external heat-exchanger. Such defrosting operation is called a reverse cycle defrosting operation. However, in the reverse cycle defrosting operation, since heat in an internal space to be air conditioned is absorbed by refrigerant flowing through the internal heat-exchanger, the heat absorption efficiency of the apparatus is relatively low, and therefore, the defrosting time may be long. This is because the internal temperature may be reduced because of interruption of the heating operation if the reverse cycle defrosting operation is carried out during the heating operation. Furthermore, the internal fan device which supplies air to the internal heat-exchanger is stopped during the reverse cycle defrosting operation to avoid a rapid temperature decrease in the internal space.

In the above-described heat-pump type air conditioning apparatus, a two stage compressor may be used to vary the compressing capacity. The two stage compressor includes a lower stage compressing device and an upper stage compressing device serially connected with one another to easily change the compressing capacity at multiple steps. The two stage compressor operates at a high efficient rate. However, in such air conditioning apparatus using the above-described two stage compressor, the heating operation also is interrupted during the execution of the defrosting operation if the above-described reverse cycle defrosting operation is adapted to the air conditioning apparatus. It is desirable to perform the defrosting operation in parallel with the heating operation. However, in the type of air conditioning apparatus described above, many components and a complicated control system are required to assure that the heating operation is continued even if the defrosting operation begins.

SUMMARY OF THE INVENTION

It is an object of the invention to effectively carry out a defrosting operation in a refrigerating circuit which includes a two stage compressing apparatus.

It is another object of the invention to maintain a heating operation even if a defrosting operation begins during the heating operation.

To accomplish the above-described objects, a refrigerating circuit apparatus includes a two stage compressing device having an upper stage compressing element and lower stage compressing element, the output port of which is connected to the input port of the upper stage compressing element, an upper stage side variable opening valve for controlling the amount of refrigerant flowing from the upper stage compressing element, and a lower stage side variable opening valve for controlling the amount of refrigerant flowing into the lower stage compressing element. The refrigerating circuit apparatus further includes a heat storage tank for storing heat therein from the refrigerant and for discharging heat therefrom to the refrigerant, an external heat-exchanger subject to accumulation of frost during a heating operation, and a control circuit for controlling the lower stage side variable opening valve to a full opening state to carry out a defrosting operation wherein refrigerant flows from the intermediate port of the two stage compressing device communicating with both the output port of the lower stage compressing element and the input port of the upper stage compressing element to the heat storage tank to absorb heat in the heat storage tank, and refrigerant flows from the heat storage tank to the external heat-exchanger through the lower stage side variable opening valve to discharge heat from refrigerant to the external heat-exchanger so as to remove frost on the external heat-exchanger.

The control circuit may include an upper stage side valve control circuit for controlling the upper stage side variable opening valve by a given degree toward its full closing position for carrying out a heat storing operation wherein refrigerant flows from the intermediate port of the two stage compressing device to the heat storage tank to discharge heat from refrigerant to the heat storage tank so as to store heat in the heat storage tank.

BRIEF DESCRIPTION OF THE DRAWINGS

These and other objects and advantages of this invention will become more readily appreciated from the following detailed description of the presently preferred exemplary embodiments of the invention, taken in conjunction with the accompanying drawings, wherein like reference numerals throughout the various figures denote like structure elements and wherein.

DETAILED DESCRIPTION OF THE PREFERRED EMBODIMENTS

Three embodiments of the present invention will now be described in more detail with reference to the accompanying drawings.

Figure 1:
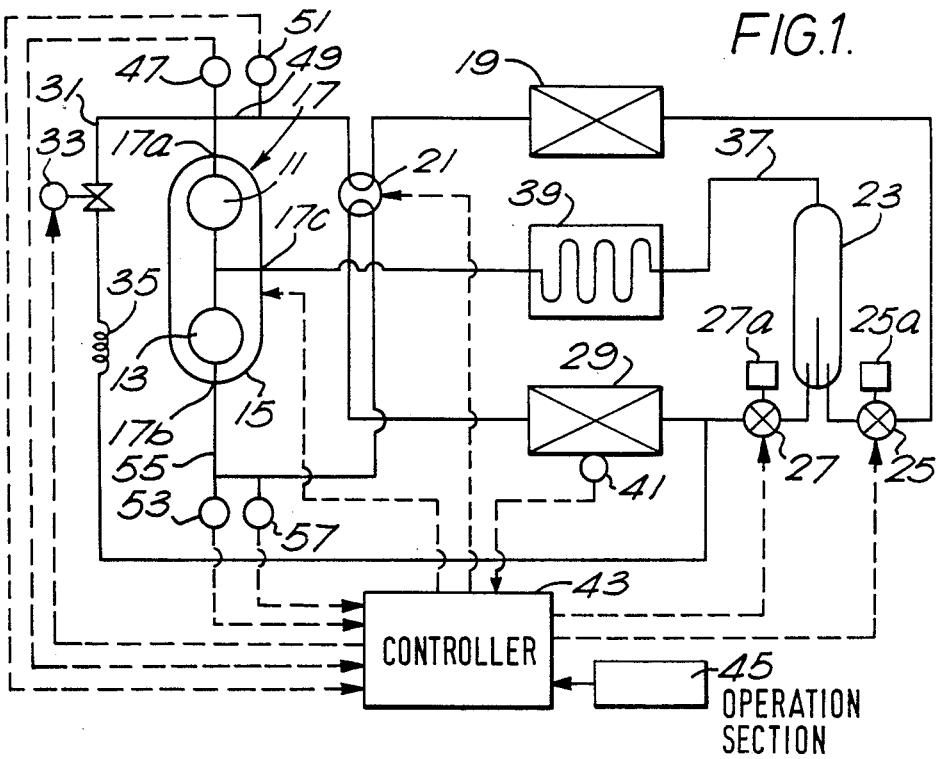
FIG. 1 is a refrigerating circuit diagram of an air conditioning apparatus of a first embodiment of the present invention.

As shown in FIG. 1, an upper stage compressing cylinder 11 and a lower stage compressing cylinder 13 are preferably assembled in a casing 15 to constitute a two stage compressor 17. Upper stage compressing cylinder 11 and lower stage compressing cylinder 13 are serially connected to one another. Each cylinder 11, 13 has input and output ports. Thus, a discharge port 17*a* of compressor 17 is in communication with the output port of upper stage compressing cylinder 11, and an intake port 17*b* thereof is in communication with the input port of lower stage compressing cylinder 13. The output port of lower stage compressing cylinder 13 is in communication with the input port of upper stage compressing cylinder 11. Two stage compressor 17 also has an intermediate port 17*c* which is in communication with the input port of upper stage compressing cylinder 11 and the output port of lower stage compressing cylinder 13. Two stage compressor 17 may be constituted by two individual compressors which are serially connected to one another. Discharge port 17*a* of compressor 17 is connected to one end of an internal heat-exchanger 19 through a four-way valve 21. The other end of internal heat-exchanger 19 is connected to a bottom portion of a liquid separator 23 through an upper stage side variable opening expansion valve 25, e.g., electronic expansion valve, which has its degree of opening controlled by a motor 25*a*, e.g., stepping motor. A lower stage side variable opening valve 27, e.g., electronic expansion valve, is connected between the bottom portion of liquid separator 23 and one end of an external heat-exchanger 29. The degree of opening of lower stage side variable opening expansion valve 27 also is controlled by a motor 27*a*, e.g., stepping motor. The other end of external heat-exchanger 29 is connected to the intake port 17*b* of compressor 17 through four-way valve 21. A bypass pipe 31 including an open/close valve 33, e.g., electromagnetic valve, and a capillary tube 35 serially connected thereto is connected between discharge port 17*a* of compressor 17 and the one end of external heat-exchanger 29. An injection pipe 37 is connected between the top side of liquid separator 23 and an intermediate port 17*c* of two stage compressor 17 through a heat storage tank 39. Heat is exchanged between heat storage tank 39 and refrigerant flowing through injection pipe 37. A temperature sensor 41, e.g., thermistor, is attached to external heat-exchanger 29 to detect the temperature of external heat-exchanger 29. The output signal of temperature sensor 41 is input to a controller 43, which includes a microcomputer and its peripheral circuits. Controller 43 controls open/close valve 33, four-way valve 21, and motors 25*a* and 27*a*. A user may input desired data to controller 43 through an operation section 45. A discharged refrigerant temperature sensor 47 is mounted on a discharge side pipe 49 of compressor 17 for detecting the temperature of the refrigerant discharged from compressor 17. A discharged refrigerant pressure sensor 51 is mounted on discharge side pipe 49 for detecting the pressure of the refrigerant. The output of each sensor 47, 51 is supplied to controller 43 to control upper stage side variable opening valve 25. An input refrigerant temperature sensor 53 is attached on an input side pipe 55 of compressor 17 for detecting the temperature of the refrigerant flowing into compressor 17. An input refrigerant pressure sensor 57 also is attached on input side pipe 55 for detecting the pressure of the refrigerant. The output of each sensor 53, 57 is also supplied to controller 43 to control lower stage side variable opening valve 27. It should be noted that internal and external fan devices (not shown) which respectively supply air to internal and external heat-exchangers 19 and 29 are controlled by controller 43.

The operation of the above-described embodiment will now be described. A user inputs an operation mode, e.g., a heating mode, and a desired internal temperature into controller through operation section 45 to initiate a starting operation. Controller 43 activates compressor 17, and switches the refrigerant flow direction by adjusting four-way valve 21, if necessary. Controller 43 closes open/close valve 33 of bypass pipe 31. Refrigerant output from discharge port 17*a* of compressor 17 flows into internal heat-exchanger 19 through four-way valve 21, as indicated by a solid arrow A in FIG. 2. Refrigerant discharges heat and is partially liquidized in internal heat-exchanger 19. The pressure of the liquidized refrigerant is reduced to a medium pressure by upper stage side variable opening expansion valve 25, and flows into liquid separator 23 where the gaseous refrigerant is separated from the liquidized refrigerant. The liquidized refrigerant flows through lower stage side variable opening expansion valve 27 to further reduce the pressure of the liquidized refrigerant from the medium pressure to a low pressure. After that, the liquidized refrigerant flows into external heat-exchanger 29 and absorbs heat from the external air through external heat-exchanger 29. Thus, the liquidized refrigerant evaporates in external heat-exchanger 29, and then, the refrigerant is drawn into lower stage compressing cylinder 13 of compressor 17 through four-way valve 21.

Figure 2:
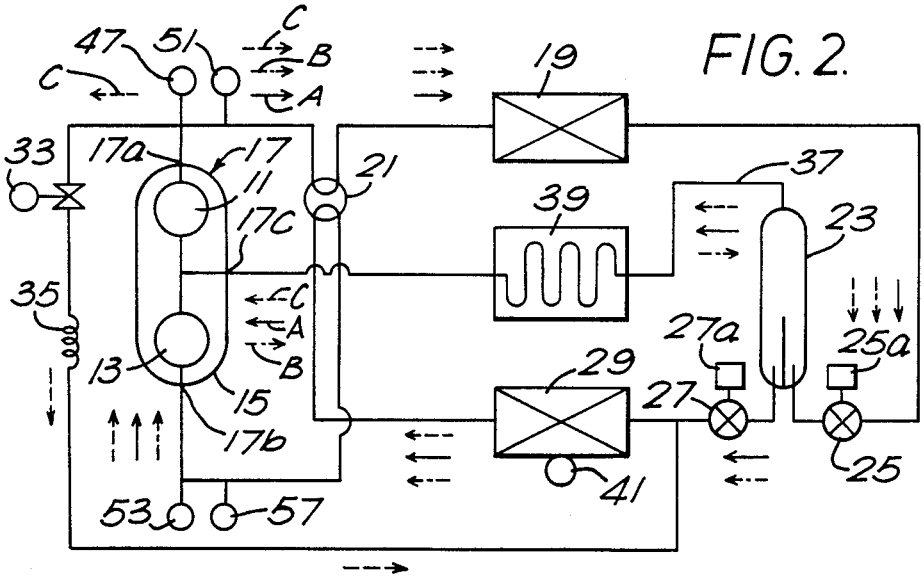
FIG. 2 is a refrigerating circuit diagram indicating refrigerant flow direction in various operating modes of the first embodiment shown in FIG. 1.

The gaseous refrigerant in liquid separator 23 flows through injection pipe 37 and is drawn into the input port of upper stage compressing cylinder 11 through intermediate port 17*c* of compressor 17, as shown in FIG. 2. At this time, lower stage side variable opening expansion valve 27 is operated to control the amount of super-heating of the refrigerant flowing into compressor 17 based on the output signal from either sensor 47 or sensor 51. Upper stage side variable opening expansion valve 25 is operated to control the medium pressure of the refrigerant to an optimum medium pressure according to the output signal from either sensor 53 or sensor 57. All of the gaseous refrigerant in liquid separator 23 is drawn into upper stage compressing cylinder 11 through intermediate port 17*c* under the optimum medium pressure. Furthermore, the maximum temperature of heat storage tank 39 is set at a saturated temperature determined by the above-described optimum medium pressure of the refrigerant. The above-described refrigerant cycle is repeated to carry out the heating operation.

During the heating operation, frost may be formed on external heat-exchanger 29 if the external temperature is low. Since, the temperature of external heat-exchanger 29 is detected by sensor 41, controller 43 determines the commencement of the defrosting operation on the basis of the output of sensor 41. If the temperature of external heat-exchanger 29 is below a prescribed low value, e.g., −10° C., a heat storing operation is carried out before the defrosting operation. In the heat storing operation, the degree of opening of upper stage side variable opening expansion valve 25 is controlled toward its closed position by controller 43 through motor 25*a*. The pressure of refrigerant flowing through upper stage side variable opening expansion valve 25 is reduced from the medium value to a prescribed low value compared with that in the heating operation. Therefore, since the specific volume of the gaseous refrigerant flowing into intermediate port 17*c* of compressor 17, i.e., the input port of upper stage compressing cylinder 11, is large, the amount of the gaseous refrigerant drawn into upper stage compressing cylinder 11 is reduced. As a result, some of the refrigerant output from lower stage compressing cylinder 13 is not drawn into upper stage compressing cylinder 11. Thus, the some of the refrigerant flows through injection pipe 37 as indicated by a dot and dashed arrow B in FIG. 2, and discharges heat into heat storage tank 39 before entering into liquid separator 23. During the heat storing operation, heat discharged from refrigerant flowing through injection pipe 37 is stored in heat storage tank 39.

In this embodiment, the heating operation is continued even if the heat storing operation is carried out. The period of the heat storing operation is measured by a timer circuit (not shown) in controller 43. When a prescribed time, e.g., 5 or 6 minutes, is measured from the beginning of the heat storing operation, open/close valve 33 of bypass pipe 31 is opened, and lower stage side variable opening expansion valve 27 is closed by controller 43 to carry out the defrosting operation. In the defrosting operation, since open/close valve 33 is opened and lower stage side variable opening expansion valve 27 is closed, a part of the refrigerant fed from discharge port 17*a* of compressor 17 flows into external heat-exchanger 29 through bypass pipe 31, as indicated by a dashed arrow C. The heat of the refrigerant is discharged to external heat-exchanger 29 to remove frost accumulated on external heat-exchanger 29. Then, the refrigerant is liquidized and returned to intake port 17*b* of compressor 17 through four-way valve 21.

As shown in FIG. 2, the remaining refrigerant fed from the discharge port 17*a* of compressor 17 flows into internal heat-exchanger 19 through four-way valve 21 to discharge its heat into internal heat-exchanger 19. Thus, the refrigerant is liquidized in internal heat-exchanger 19, and flows into heat storage tank 39 through upper stage side variable opening expansion valve 25 and liquid separator 23. Refrigerant flowing through heat storage tank 39 absorbs heat stored in heat storage tank 39 and is drawn into the input port of upper stage compressing cylinder 11 together with the refrigerant from lower stage compressing cylinder 13. The above-described heating operation is carried out while the defrosting operation is executed. At this time, upper stage side variable opening expansion valve 25 is controlled to maintain the amount of super-heating of the refrigerant at the discharge side of heat storage tank 29 at a constant value during the defrosting operation.

As stated above, heat stored in heat storage tank 39 is used to remove frost formed on external heat-exchanger 29, and also is used to heat a defined space to be air conditioned. During the defrosting operation, the temperature of external heat-exchanger 29 is detected by sensor 41. When temperature of external heat-exchanger 29 gradually increases, and reaches a prescribed value, e.g., +10° C., open/close valve 33 is closed, and lower stage side variable opening expansion valve 27 is opened by controller 43. Thus, the defrosting operation is terminated, and the normal heating operation is restarted.

It should be noted that a reverse refrigerant cycle is performed by operating four-way valve 21 when a cooling operation is carried out. At this time, lower stage side variable opening expansion valve 27 is operated to control the medium pressure of the refrigerant to an optimum medium pressure. Upper stage side variable opening expansion valve 25 is operated to control the amount of super-heating of the refrigerant flowing into compressor 17.

In the above-described first embodiment, the heat storing operation is carried out by controlling upper stage variable opening valve 25. The defrost operation is carried out by controlling lower stage side variable opening valve 27 and open/close valve 33. The heating operation is continuously executed even if the heat storing and the defrosting operations begin during the heating operation.

Figure 3:
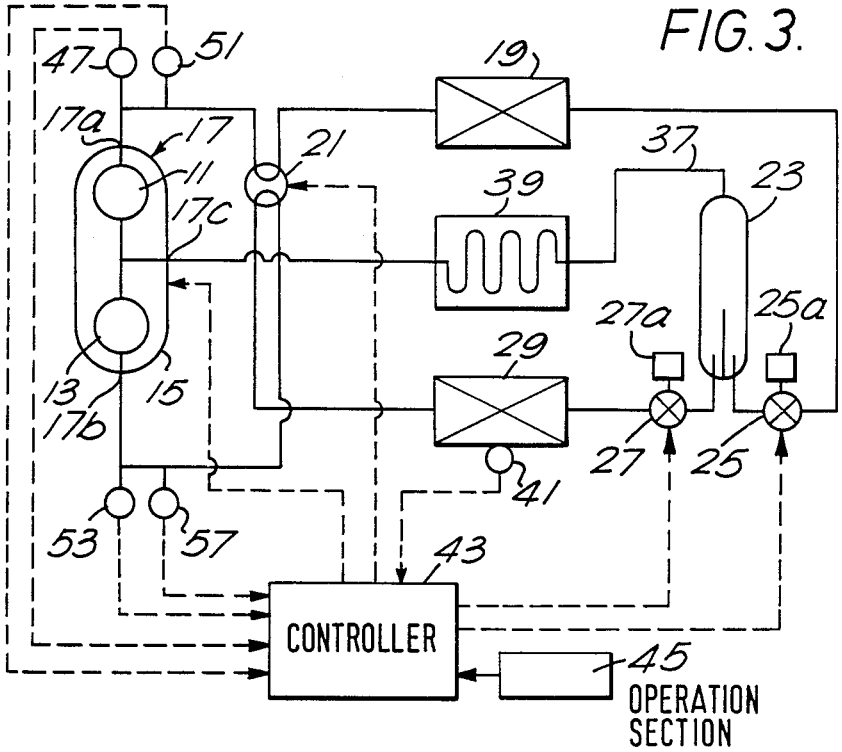
FIG. 3 is a refrigerating circuit diagram of a second embodiment of the present invention.
Figure 4:
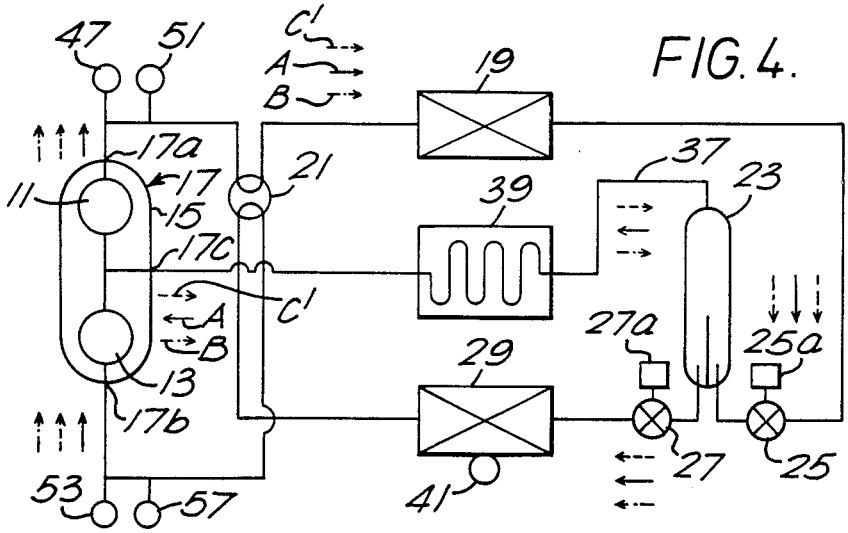
FIG. 4 is a refrigerating circuit diagram indicating refrigerant flow direction in various operating modes of the second embodiment shown in FIG. 3.

A second embodiment of the present invention will now be described hereafter by referring to FIGS. 3 and 4. In the drawings, the same numerals are applied to similar elements, and therefore, the detailed description thereof will not be repeated. In the second embodiment, bypass pipe 31 of the first embodiment is removed. Therefore, the defrosting operation of the second embodiment is different from that of the first embodiment.

The operation of the second embodiment will now be described. Since the refrigerant flow in the heating and the heat storing operations of this embodiment is similar to that of the first embodiment, the direction of the refrigerant flow is indicated by the same arrow symbols with alphabetic identification, and therefore, the detailed description thereof is not repeated.

Lower stage variable opening expansion valve 27 is opened by controller 43 to carry out a defrosting operation a prescribed period of time after a heat storing operation begins. As indicated by an dotted arrow C′ in FIG. 4, a part of the refrigerant output from intermediate port 17*c* of compressor 17, i.e., the output port of lower stage compressing cylinder 13, flows into injection pipe 37. Refrigerant flowing through injection pipe 37 absorbs heat stored in heat storage tank 39 and enters into liquid separator 23. The remaining refrigerant is drawn into upper stage compressing cylinder 11, and is compressed in cylinder 11. Refrigerant discharged from the output port of compressor 17 flows into internal heat-exchanger 19 through four-way valve 21 to discharge heat to a closed space to be heated. Thus, the refrigerant flowing through internal heat-exchanger 19 is liquidized, and enters into liquid separator 23 through upper stage variable opening expansion valve 25. The gaseous refrigerant flowing from injection pipe 37 and the liquidized refrigerant flowing from internal heat-exchanger 19 are mixed in liquid separator 23, and the mixed refrigerant further flows into external heat-exchanger 29 through lower stage variable opening expansion valve 27. In external heat-exchanger 29, the refrigerant discharges heat to remove frost accumulated on external heat-exchanger 29, and is liquidized to a certain extent. After that, the refrigerant is drawn into lower stage compressing cylinder 13 of compressor 17.

The above-described refrigerant cycle is repeated until frost formed on external heat-exchanger is removed.

As stated above, in this embodiment also, the heating operation is continued even though the defrosting operation begins. Heat stored in heat storage tank 39 is used for removing frost adhered on external heat-exchanger 29 and also is used for heating the defined space.

Figure 5:
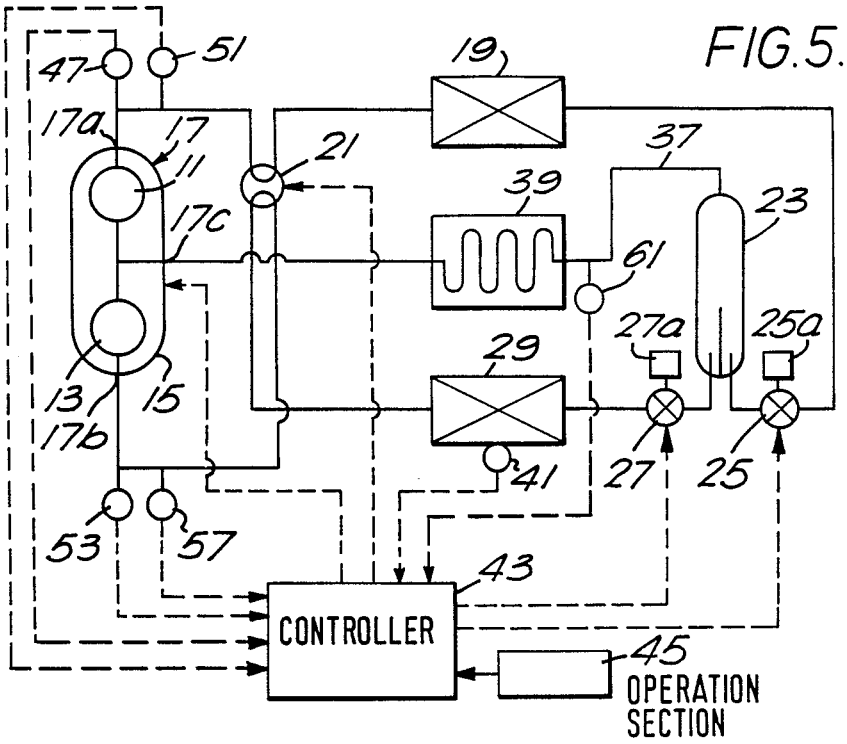
FIG. 5 is a refrigerating circuit diagram of a third embodiment of the present invention.
Figure 6:
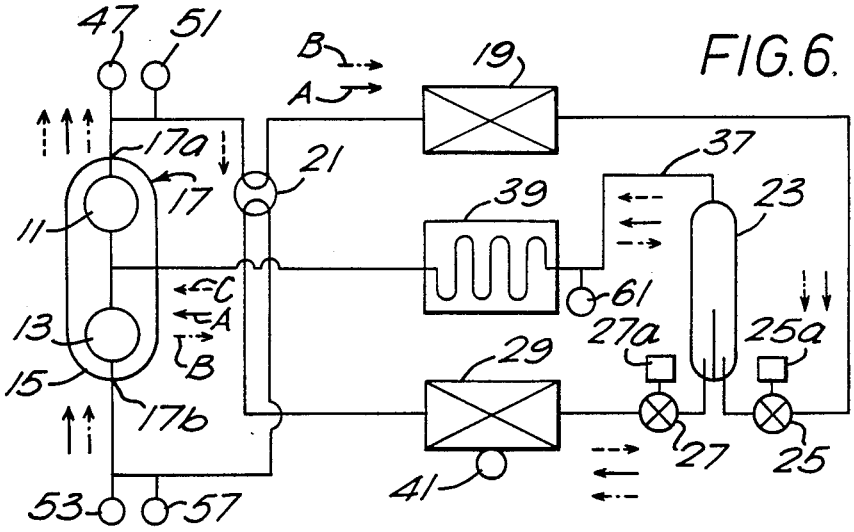
FIG. 6 is a refrigerating circuit diagram indicating refrigerant flow direction in various operating modes of the third embodiment shown in FIG. 5.

A third embodiment of the present invention will be described hereafter with reference to FIGS. 5 and 6. In the drawings, the same numerals are applied to similar elements, and therefore, the detailed description thereof is not repeated. In the third embodiment, a stored heat temperature sensor 61 is mounted on injection pipe 37 located between heat storage tank 39 and liquid separator 23 for detecting the temperature of refrigerant flowing from heat storage tank 39. The output signal of sensor 61 is used for determining whether the heat storing operation is completed.

The operation of the third embodiment will now be described. Since the refrigerant flow in the heating and the heat storing operations of this embodiment is similar to that of the first embodiment, the direction of the refrigerant flow is indicated by the same arrow symbols with alphabetic identification, and therefore, the detailed description thereof is not repeated.

If the temperature of external heat-exchanger 29 detected by sensor 41 is below a prescribed value, e.g., −10° C., during a heating operation, a heat storing operation is carried out prior to a defrosting operation. In the heat storing operation, upper stage variable opening expansion valve 25 is controlled toward its closed position by controller 43. As stated before, some of the refrigerant from lower stage compressing cylinder 13 flows through injection pipe 37, through intermediate port 17*c* of compressor 17, as indicated by a dot and dashed arrow B in FIG. 6, and discharges heat to heat storage tank 39 before flowing into liquid separator 23. During the heat storing operation, heat discharged from refrigerant flowing through injection pipe 37 is stored in heat storage tank 39. In the first and the second embodiments, the timer circuit is used for measuring the heat storing operation period. However, in the third embodiment, stored heat temperature sensor 61 is employed for determing the completion of the heat storing operation. The temperature of refrigerant detected by sensor 61 decreases with the progress of the heat storing operation. However, the refrigerant temperature change detected by sensor 61 switches from a decreasing to an increasing when the temperature of heat storage tank 39 approaches a certain level. The temperature change of the refrigerant detected by sensor 61 becomes small, and finally, the temperature of the refrigerant is stable at a prescribed level when the temperature of heat storage tank 39 reaches a saturated temperature. Thus, completion of the heat storing operation is determined when a temperature stable condition of the refrigerant is detected by controller 43 through sensor 41. When the defrosting operation is initiated after the heat storing operation, four-way valve 21 is turned to a cooling position, and upper stage variable opening expansion valve 25 is closed. Refrigerant discharged from discharge port 17*a* of compressor 17 flows into external heat-exchanger 29 through four-way valve 21, and discharges heat to remove frost accumulated on external heat-exchanger 29. After discharging heat, the refrigerant further flows to injection pipe 37 through lower stage variable opening expansion valve 27 and liquid separator 23. Refrigerant flowing through injection pipe 37 absorbs heat stored in heat storage tank 39 and evaporates, and is drawn to intermediate port 17*c* of compressor 17. At this time, since upper stage variable opening expansion valve 25 is closed, lower stage compressing cylinder 13 operates under an unloaded state during the defrosting operation. However, no practical problems occur during the above-described operation because of this unloaded state.

In the above-described third embodiment, since refrigerant fed from compressor 17 does not flow to internal heat-exchanger 19 during the defrosting operation, the heating operation is interrupted during the defrosting operation. However, since heat stored in heat storage tank 39 is used for removing frost formed on external heat-exchanger 29, the defrosting operation period is reduced compared with the first and the second embodiments.

According to the above-described embodiments, since the refrigerating circuit wherein the two stage compressing apparatus is used includes heat storage tank 39 and two variable opening expansion valves 25 and 27 to execute the heat storing operation, heat discharged from the refrigerant is effectively stored in heat storage tank 39 by controlling the opening of two variable opening expansion valves 25 and 27. Furthermore, heat stored in heat storage tank 39 is discharged by controlling only the opening of two variable opening expansion valves 25 and 27. Therefore, the defrosting operation is carried out effectively, and heat stored in the heat storage tank can be used not only for the defrosting operation but also for the heating operation during the defrosting operation.

In the above-described embodiments, the present invention is applied to an air conditioning apparatus. However, the invention may also be applied to a water heater without departing from the scope and teaching of the invention.

The present invention has been described with respect to specific embodiments. However, other embodiments based on the principles of the present invention should be obvious to those of ordinary skill in the art. Such embodiments are intended to be covered by the claims.

What is claimed is:

1. A refrigerating circuit apparatus comprising:

two stage compressing means including a lower stage compressor element and an upper stage compressor element connected in series for compressing refrigerant, each compressor element respectively having an input port and output port, the output port of the lower stage compressor element being in communication with the input port of the upper stage compressor element, the two stage compressing means having an intermediate port communicating with the output port of the lower stage compressor element and the input port of the upper stage compressor element;

liquid separation means for separating liquid and gaseous refrigerant, said liquid separation means including an inlet port, an outlet port and an intermediate port;

upper stage side variable opening valve means disposed in-line between said output port of said upper stage compressor element and said input port of said liquid separation means for controlling the flow amount of refrigerant exiting the output port of the upper stage compressor element between a fully open position and a fully closed position;

lower stage side variable opening valve means disposed in-line between said output port of said liquid separation means and said input port of said lower stage compressor element for controlling the flow amount of refrigerant into the input port of the lower stage compressor element between a fully open position and a fully closed position;

heat storage means disposed in-line between said intermediate port of said two stage compressor means and said intermediate port of said liquid separation means, said heat storage means for storing heat therein from the refrigerant or for discharging heat therefrom to the refrigerant;

heat-exchange means disposed in-line between said lower stage side variable opening means and said input port of said lower stage compressor element, said heat exchange means for exchanging heat with the refrigerant, the heat-exchange means including an external heat-exchanger subject to accumulation of frost thereon; and means for controlling the lower stage side variable opening valve means to the fully open position to carry out a defrosting operation wherein refrigerant flows from the intermediate port of the two stage compressing means to the heat storage means to absorb heat into the refrigerant from the heat storage means, and refrigerant then flows from the heat storage means to the external heat-exchanger through the lower stage side variable opening valve means to discharge the absorbed heat from the refrigerant to the external heat-exchanger thereby removing frost accumulated on the external heat-exchanger.

2. An apparatus according to claim 1, wherein the controlling means includes upper stage valve control means for controlling the upper stage side variable opening valve means to a selected position between fully open and fully closed positions for carrying out a heat storing operation wherein refrigerant flows from the intermediate port of the two stage compressing means to the heat storage means to discharge heat from the refrigerant into the heat storage means so as to store the heat in the heat storage means.

3. An apparatus according to claim 2, wherein the controlling means includes a first temperature sensor means for detecting the temperature of the external heat-exchanger.

4. An apparatus according to claim 3, wherein the controlling means further includes means for starting the heat storing operation prior to the defrosting operation when the temperature of the external heat-exchanger is below a prescribed value.

5. An apparatus according to claim 4, wherein the controlling means includes second temperature sensor means for detecting the temperature of the refrigerant flowing from the heat storage means for determining the completion of the heat storing operation.

6. An apparatus according to claim 4, wherein the controlling means includes timer means for measuring the time period of the heat storing operation for determining the completion of the heat storing operation.

7. An apparatus according to claim 1, further comprising an internal heat-exchanger disposed in-line between said output port of said upper stage compressor element and said upper stage side variable opening valve means, said controlling means further including means for causing the flow of refrigerant from the output port of the upper stage compressor element to the internal heat-exchanger to be maintained even if a defrosting operation begins.

8. An apparatus according to claim 1, wherein the controlling means includes third temperature sensor means for detecting the temperature of the refrigerant flowing from the output port of the upper stage compressor element.

9. An apparatus according to claim 1, wherein the controlling means includes fourth temperature sensor means for detecting the temperature of the refrigerant flowing to the input port of the lower stage compressor element.

* * * * *